United States Patent [19]

Chawla et al.

[11] Patent Number: 4,862,804

[45] Date of Patent: Sep. 5, 1989

[54] IMPLOSION SHAPED CHARGE PERFORATOR

[75] Inventors: Manmohan S. Chawla; Nicholas Collier, both of Houston; Steven D. Sehnert, Katy, all of Tex.

[73] Assignee: Western Atlas International, Inc., Houston, Tex.

[21] Appl. No.: 736,741

[22] Filed: May 22, 1985

[51] Int. Cl.[4] ..... F42B 1/02

[52] U.S. Cl. ..... 102/309; 102/307; 102/476; 102/506

[58] Field of Search ..... 102/306–310, 102/476, 506

[56] References Cited

U.S. PATENT DOCUMENTS

| | | | |
|---|---|---|---|
| 3,186,304 | 6/1965 | Biehl | 102/306 X |
| 3,443,518 | 5/1969 | Cross | 102/306 |
| 4,253,523 | 3/1981 | Ibsen | 166/299 |
| 4,359,943 | 11/1982 | Majerus | 102/309 |
| 4,387,773 | 6/1983 | McPhee | 175/4.6 |
| 4,425,850 | 1/1984 | Grossler | 102/307 |
| 4,441,428 | 4/1984 | Wilson | 102/307 |
| 4,450,768 | 5/1984 | Ball | 102/307 |
| 4,481,886 | 11/1984 | Brattstrom et al. | 102/476 |
| 4,487,130 | 12/1984 | Brattstrom et al. | 102/476 |

OTHER PUBLICATIONS

Birkhoff et al., "Explosives with Lined Cavities, " *J. Applied Physics,* 19 (Jun. 1948), pp. 563–582.

Pugh et al., "Theory of Jet Formation by Charges with Lined Conical Cavities," *J. Applied Physics,* 23 (May 1952), pp. 532–536.

Eichelberger, "Re-Examination of the Nonsteady Theory of Jet Formation by Lined Cavity Charges," *J. Applied Physics,* 26 (1955), pp. 398–402.

Yang, "Performance Characteristics of a Laser Initiated Microdetonator," *Propellants and Explosives,* 6 (1981), pp. 151–157.

*Primary Examiner*—Peter A. Nelson

*Attorney, Agent, or Firm*—Patrick H. McCollum

[57] ABSTRACT

An implosion shaped charge device for jet perforating. In its overall concept, the implosion shaped charge perforator comprises a liner of implosive geometry, a primary explosive contiguous to the liner for providing implosion impulse to such and means for detonating the primary explosive. In a first embodiment the detonating means is an explosively actuated impact detonator. In a second embodiment the detonating means is a laser initiated explosive detonator. Both embodiments may be utilized in a perforating gun for perforating subsurface earth formations. In the operation of the embodiments the primary explosive is detonated with the resulting detonation wave approximately constantly accelerating the liner to radially converge to a small volume, from which a jet is propagated in the direction of the maximum pressure gradient.

15 Claims, 4 Drawing Sheets

IMPLOSION SHAPED CHARGE PERFORATOR

BACKGROUND OF THE INVENTION

This invention relates generally to improved perforating methods and apparatus and, more specifically, to novel shaped charge devices for use in perforating operations.

It has become common practice in the oil and gas industry to perforate the well casing of an oil and gas well to bring such well into production. Shaped charges have long been used for this purpose.

Oil well perforating shaped charges are often required to work in very restrictive environments. The logistics of transporting such devices from the warehouse to the field, the desire to keep the gun and borehole damage to a minimum as well as numerous other safety considerations dictate that a minimum amount of high explosive (HE) be used and that such HE be used most efficiently. The space constraints within a borehole further require that significant jet stretching takes place in the shortest possible standoff distance. It is also desirable to have a minimum of slug, and to have a jet with a high tip velocity, high velocity gradient, high density and high mass. A higher mass in the jet enlarges the jet diameter which in turn produces a large entry hole while higher jet velocities increase the depth of penetration.

All of these objectives can be met with only limited success by employing a conventional shaped charge, wherein a conical or hemispherical cavity in a mostly cylindrical body of HE is lined with a conical or hemispherical liner of copper or other suitable material. In such shaped charges, the HE is initiated at the end opposite the liner. Detonation waves originating at this initiation point travel toward the liner apex then proceed toward the liner base. As a consequence of the enormous pressure exerted by the detonation, the liner moves toward the liner axis which is also the axis of symmetry. In the conventional design, the liner material arrives on the axis segment-by-segment where it divides into two parts, the jet and the slug. Typical jet tip velocities range from 5–8 km/sec depending on the liner material, cone angle and the amount and type of HE.

While the jet velocities of conventional shaped charges are fairly high, these velocities cannot be increased much further because of an inefficient explosive geometry. The detonation waves within such conventional charges impact upon the liner at oblique angles; therefore, a significant portion of the explosive energy is reflected away from rather than transmitted to the liner. This limitation on the jet velocities results in a limitation on the depth of penetration, which is further limited by the use of copper as the liner material. Copper is a popular choice because of its high ductility and low cost; however, copper's low density limits the pressure exerted by the jet and thereby limits the penetration.

These and other disadvantages are overcome by the present invention which employs a high density, sufficiently ductile liner material geometrically arranged in an implosion configuration. Implosion devices are inherently more efficient than point initiated devices because the detonation waves impinge upon the liner surface simultaneously at normal angles. This simultaneous impingement accelerates the entire liner simultaneously toward the center in a radially convergent fashion. In contrast, the liner of the conventional shaped charge is accelerated in sections form the apex to the base. The present invention also provides means and methods for accomplishing such stimultaneous impingment so that the liner receives the impulse from the detonation wave simultaneously over the entire liner surface.

SUMMARY OF THE INVENTION

In accordance with the present invention, an implosion jet perforating or implosion shaped charge device is provided which, in its overall concept, comprises a liner shaped in an implosive geometry, a primary explosive contiguous to the liner for providing implosive impulse to such and means for detonating the primary explosive.

In a first embodiment, an implosion shaped charge device is provided which comprises a liner, primary explosive and explosively actuated impact detonator means for detonating the primary explosive. The liner is preferably a hemispherically shaped high density material having sufficient ductility under the explosive conditions encountered during the detonation of the device to allow the desired jet formation. One appropriate material is a ductile composition of depleted uranium such as DU-6Nb.

Contiguous to the liner is the primary explosive, which is preferably a hemispherically shaped quantity of high explosive such as RDX.

The explosively actuated impact detonator means comprises a throw plate, an auxiliary explosive contiguous to the throw plate and a booster to detonate the auxiliary explosive. The throw plate is comprised of a parabolically or conically shaped frangible material, such as glass or aluminum, which under the explosive impulse of the auxiliary explosive produces particles to impact upon the primary explosive. The impact detonator means is configured within the implosion device so that the arrival of the particles from the throw plate to the primary explosive is approximately simultaneous.

A cylindrically steel body having a cavity therein may be provided to house the implosion device, and a flange may be secured to such device for directing the imploded liner material and delaying the arrival of relief waves.

In the operation of the first embodiment, the booster is detonated by conventional means, the detonation of the booster in turn detonating the auxiliary explosive. As the detonation impulse from the auxiliary explosive impinges upon the throw plate, a continuum of fine particles is formed and accelerated into detonating impingement with the primary explosive. The detonation impulse from the primary explosive then arrives approximately simultaneously upon the liner forcing such to converge radially and collapse into a small volume. From this volume a jet is propagated in the direction of the maximum pressure gradient, that direction being through the opening in the flange and into the object being perforated.

A secondary detonation mechanism may also be utilized to ensure the proper detonation of the primary explosive. This mechanism comprises impressing conical or V-shaped cavities into the throw plate. These cavities will produce small shaped charge jets in response to the explosive impulse of the auxiliary explosive. The jets will in turn detonate the primary explosive at multiple impact points, with the remaining particles from the throw plate providing the necessary confinement for the spread of the detonation wave in the primary explosive. Another embodiment of the secondary mechanism employs fragment impact instead of jet impact by utilizing caps or dimples instead of conical or V-shaped cavities.

In applying the first embodiment of the implosion device for use in the oil and gas industry, a shaped charge gun of conventional design may be loaded with a plurality of the implosion devices for perforating subsurface earth formations.

In a second embodiment of the implosion shaped charge device, the primary explosive is detonated by a laser initiated explosive detonator means. Further in this second embodiment, contiguous to the primary explosive is an auxiliary explosive for use as a booster. Contiguous to the auxiliary explosive is a housing which houses a plurality of laser initiated microdetonators for detonating the auxiliary explosive. Each of the microdetonators is coupled to a laser initiation system by optical coupler and optical fibers. The second embodiment is housed in a strain relief which comprises a molded plastic body contiguous to the microdetonator housing. The optical fibers are set within the strain relief during its molding, and are optically coupled to the laser initiation system by the optical cononectors. The second embodiment may also have a flange secured to the device for guiding the imploded liner material and for delaying the arrival of relief waves.

In the operation of the second embodiment, a laser in the laser initiation system is pulsed with sufficient energy to detonate the plurality of microdetonators. The impulse from this detonation in turn detonates the auxiliary explosive at multiple points along its outer surface. The resulting detonation wave spreads to the primary explosive, with the impulse from this detonation providing the implosive impulse to the liner. Due to the multiple point detonation of the auxiliary explosive, however, the detonation front reaching the liner will be uneven and thereby preferentially accelerate those portions of the liner opposite the initiation sites. Such "ripple" effect is lessened by the venting of gases through the recesses which have become gas-venting holes due to the detonation of the microdetonators. This gas venting lessens the impulse at the points of the liner which were preferentially accelerated, thereby providing a more uniform impulse to the liner with the effect of having approximately constant acceleration over its entire surface. The constant acceleration forces the liner to converge radially and collapse into a small volume, from which a jet is propogated in the direction of the maximum pressure gradient, that direction being through the opening of the flange and into the object being perforated.

In applying this second embodiment for use in the oil and gas industry, a plurality of the implosion devices may be loaded into a shaped charge perforating gun to perforate subsurface earth formations. Each of the devices may be optically coupled to a branch of the main fiber bundle by an optical connector. The main fiber bundle is connected through a seal system to another optical connector for providing the necessary optical coupling to the laser of the laser and power supply, such being housed in a separate portion of the gun to isolate it from the explosive blasts of the implosion devices.

These and other features of the present invention will be more readily understood by those skilled in the art from a reading of the following detailed description with reference to the accompanying drawings.

DETAILED DESCRIPTION OF THE PREFERRED EMBODIMENT

The present invention provides an implosion jet perforating or implosion shaped charge device and methods for implosively detonating such. In its overall concept the implosion device comprises a liner shaped in an implosive geometry, a primary explosive contiguous to the liner for providing implosive impulse to such and means for detonating the primary explosive.

Higher efficiency shaped charge designs are possible if the liner as well as the primary explosives are shaped in an implosive geometry, the preferred shape being hemispherical. If in this design the primary explosive is detonated so that the resulting detonation impulse arrives at the liner surface simultaneously, the forces from such detonation impulse will cause the liner to converge radially and collapse simultaneously to a small volume. Within this region the pressures as well as the densities achieve extremely high values, resulting in high velocity material extrusion or jet propagation in the direction of the maximum pressure gradient. Unlike the segment-by-segment collapse of the conventional designs characterized by a prominent stagnation region, the imploded liner segments act together in forming the jet.

Efficiency of shaped charge designs may also be enhanced by employing a high density liner material. High density liner materials increase the jet mass which in turn increases the perforation hole size and depth of penetration. By combining the implosive geometry and the high density liner material, a high efficiency shaped charge device is produced which has a high jet mass, high jet velocity, high jet velocity gradient and a minimum of slug, such device thereby producing a better perforation.

Figure 1:
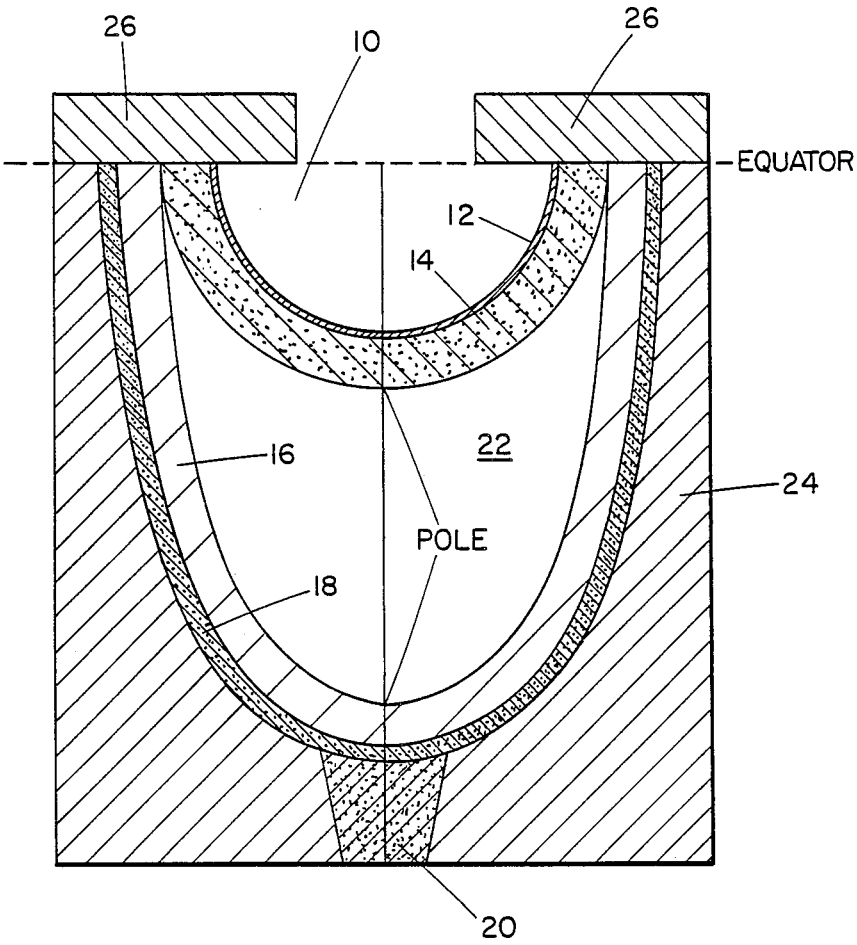
FIG. 1 is a cross-sectional view of a first embodiment of an implosion shaped charge device in accordance with the present invention.

Now referring to the drawings in more detail, particularly to FIG. 1, there is illustrated a first embodiment of an implosion shaped charge device in accordance with the present invention. Implosion shaped charge device 10, in its overall concept, comprises liner 12, primary explosive 14 and explosively actuated impact detonator means for detonating primary explosive 14, such detonation occurring approximately simultaneously over the outer surface of primary explosive 14. Liner 12 is preferably constructed in a hemispherical shape of a high density liner material, such high density liner material having sufficient ductility under the explosive conditions encountered during the detonation of device 10 to allow the desired jet formation. In the prefrred embodiment liner 12 is comprised of approximately 26 grams of a ductile composition of depleted uranium (DU), such as DU-6Nb, hemispherically shaped, with an outer diameter of approximately 1.336 inches and a thickness of approximately 0.03 inches.

Contiguous to the outer surface of liner 12 is primary explosive 14. In the preferred embodiment primary explosive 14 is also of hemispherical shape, comprising approximately 22.5 grams of the commercially available explosive RDX.

As previously mentioned, primary explosive 14 is detonated approximately simultaneously over the outer surface to produce the implosion forces necessary for the high efficiency of device 10. Conventional designs employ point-initiated or ring-initiated detonation schemes which are not applicable to the present invention since they do not provide the required simultaneous detonation of primary explosive 14. To accomplish such, the present invention utilizes a plate-throw means as is illustrated in FIG. 1. The plate-throw means comprises throw plate 16, auxiliary explosive 18 contiguous to the outer surface of throw plate 16 and booster 20 to detonate auxiliary explosive 18. Throw plate 16 is comprised of a frangible material which, under the explosive impulse of auxiliary explosive 18, produces particles which travel through gap 22 to impact primary explosive 18. As can be seen from FIG. 1, gap 22 is largest at the pole of primary explosive 14, with the width of gap 22 reducing from the pole to the equator. Thus the portion of throw plate 16 first to be accelerated travels the furthest, with gap 22 so configured that the arrival of the particles from throw plate 16 to primary explosive 14 is approximately simultaneous. The contour of throw plate 16 is thus the locus of points from which the time for the detonation wave arrival from auxiliary explosive 18 to throw plate 16 plus the incubation time for the particle acceleration from throw plate 16 plus the time of travel of the particles from throw plate 16 to primary explosive 14 is approximately constant.

In the preferred embodiment, throw plate 16 is comprised of approximately 33.5 grams of glass of aluminum, the shape of throw plate 16 being preferably conical or parabolic as defined by the following relationship:

$$\frac{ds}{dr} = \frac{D}{Vs} \tag{1}$$

wherein ds=the differential arc length measured along the curved portion of throw plate 16;

dr=the difference in the radial distance measured from the center of the ellipse to the ends of the arc ds;

D=auxiliary explosive 18 detonation velocity; and

Vs=throw plate 16 throw velocity which is a function of auxiliary explosive 18 to throw plate 16 mass ratio and auxiliary explosive 18 Gurney velocity.

Further in the preferred embodiment, the maximum gap length between throw plate 16 and primary explosive 14 follows the relationship:

$$1\ \text{pole} = \left(\frac{\pi}{2}\ \frac{R}{D} + \frac{leq}{Vs}\right) \Big/ \left(\frac{1}{Vs} - \frac{\pi}{4}\ \frac{1}{D}\right) \tag{2}$$

wherein 1 pole=the gap length between the pole of primary explosive 14 and throw plate 16 (which is the maximum gap);

R=the radius of primary explosive 14;

D=auxiliary explosive 18 detonation velocity;

Vs=throw plate 16 velocity; and leq=gap width at the equator (which is preferably zero).

Still further in the preferred embodiment, auxiliary explosive 18 is comprised of a uniformly thick sheet explosive, preferably approximately 10 grams of commercially available Detasheet of cyclonite.

For housing the above described implosion device, charge case 24 is provided which preferably comprises a cylindrical steel body having a cavity therein, such cavity conforming to the shape of the throw plate detonation assembly. Charge case 24 further has a central booster cavity for housing booster 20.

For guiding the liner material toward the center of the implosion area and for delaying the arrival of relief waves, flange 26 secured to charge case 24 is provided which preferably comprises a steel body having an inner diameter of approximately 0.8 inches and a thickness of approximately 0.2 inches. Flange 26 may be secured to charge case 24 by any number of conventional methods such as, but not limited to, welding, glueing or form fitting.

In the preferred operation of device 10, booster 20 is detonated by conventional means such as a detonator cord-detonating cap assembly, the detonation of booster 20 in turn detonating auxiliary explosive 18. As the detonation impulse from auxiliary explosive 18 impinges upon throw plate 16, a continuum of fine particles is formed and accelerated through gap 22 into detonating impingement with primary explosive 14. As previously mentioned, throw plate 16 and gap 22 are configured so that primary explosive 14 is detonated approximately simultaneously over its outer surface, that is, the particles formed from throw plate 22 impinge upon the outer surface of primary explosive 14 approximately simultaneously. The detonation impulse thereby produced further arrives approximately simultaneously upon the outer surface of liner 12 forcing such to converge radially and collapse into a small volume. From this volume a jet is propagated in the direction of the maximum pressure gradient, that direction being through the opening of flange 26 and into the object being perforated.

Figure 2A:
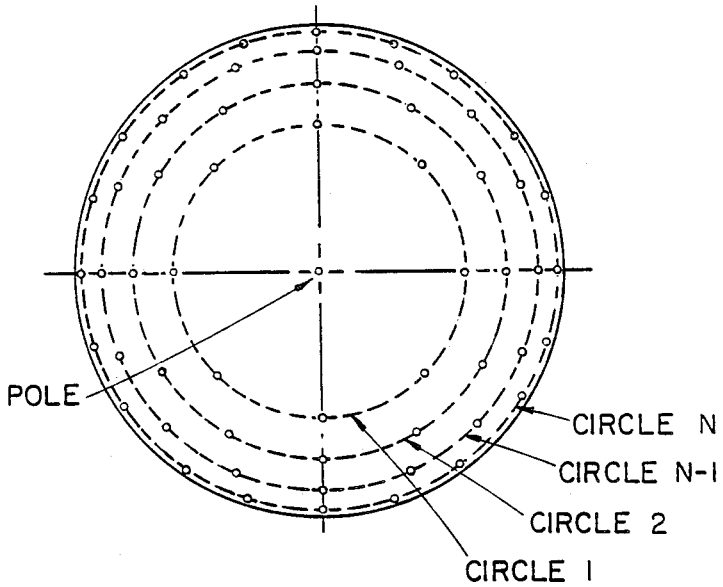
FIG. 2A is a top-view of the implosion shaped charge device illustrating the arrangement of the cavities in a plurality of circles.

In order to ensure that primary explosive 14 does indeed detonate simultaneously over its outer surface, a redundant detonation mechanism may be employed. This secondary mechanism utilizes conical or V-shaped cavities which are impressed into the inner surface of throw plate 16. The depths of these cavities is constant, but the included angle of the cones progressively decreases from the pole to the equator. As can be seen from FIG. 2A, the cavities are arranged upon throw plate 16 in a plurality of circles, the planes of which are arranged parallel to the equator. The number of cavities impressed in a specific circle follows the relationship:

$$n = \frac{2\pi \sin k\phi}{\phi} \tag{3}$$

wherein $k = 1, 2, \ldots, N$th circle;

$\phi = \pi/(2N + 1)$.

Figure 2B:
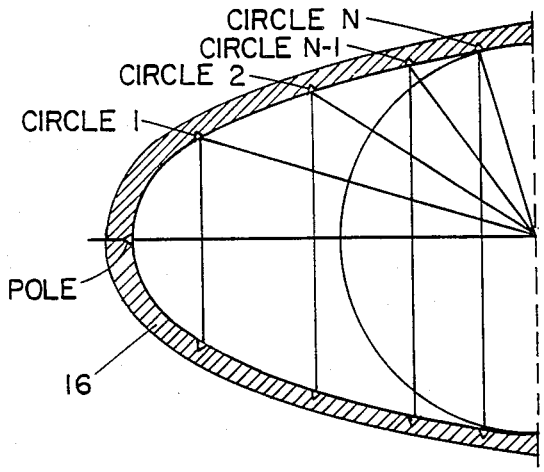
FIG. 2B is a side-view of the implosion shaped charge device illustrating the the arrangement of the plurality of circles of FIG. 2A.

It should be noted that a single cavity also occurs at the pole on the inner surface of throw plate 16. As can be seen from FIG. 2B, the plurality of circles are arranged on throw plate 16 so that the lines joining the cavities and the center of the hemispherical portion of primary explosive 14 divide the curved surface of primary explosive 14 into equal area segments.

In the preferred operation of this secondary mechanism, booster 20 is detonated by conventional means, the detonation of booster 20 in turn detonating auxiliary explosive 18. As the resulting detonation impulse impinges upon the apex of each of the cavities, a small shaped charge jet is formed. The velocity of such jet is dependent upon the angle of the V or cone—the smaller the angle, the higher the jet velocity. These angles are arranged so that the sum of the arrival time of the detonation impulse to each cavity plus the time of jet formation plus the travel time of the jets to primary explosive 14 is approximately constant for all cavities. Primary explosive 14, therefore, is detonated at multiple inpact points from the jets, with the remaining particles from throw plate arriving subsequent to the jets to provide the necessary confinement for the spread of the detonation wave in primary explosive 14.

Another embodiment of the secondary mechanism employs fragment impact instead of jet impact by utilizing caps or dimples instead of conical or V-shaped cavities. The arrangement of the caps and dimples is similar to that of the cavities, with the diameter and depth of the caps and dimples being such that the sum of the arrival time of the detonation impulse to each cap or dimple plus the time for fragment formation plus the travel time of the resulting fragment to primary explosive 14 is approximately constant for each cap or dimple.

In applying device 10 for use in the oil and gas industry, a shaped charge perforating gun of conventional design may be loaded with a plurality of the shaped charge implosion devices for perforating a subsurface earth formation. Preferably the perforating gun comprises a generally elongated tubular gun body having a plurality of apertures therein for housing one or more of the implosion devices within the gun. Further, the gun may be adapted to be lowered into a well bore by any conventional means such as, but not limited to, tubing conveyed or attached to the end of a single or multiconductor cable and cablehead assembly. Still further, the gun may be actuated by any conventional means such as, but not limited to, electrical or mechanical means.

Figure 3:
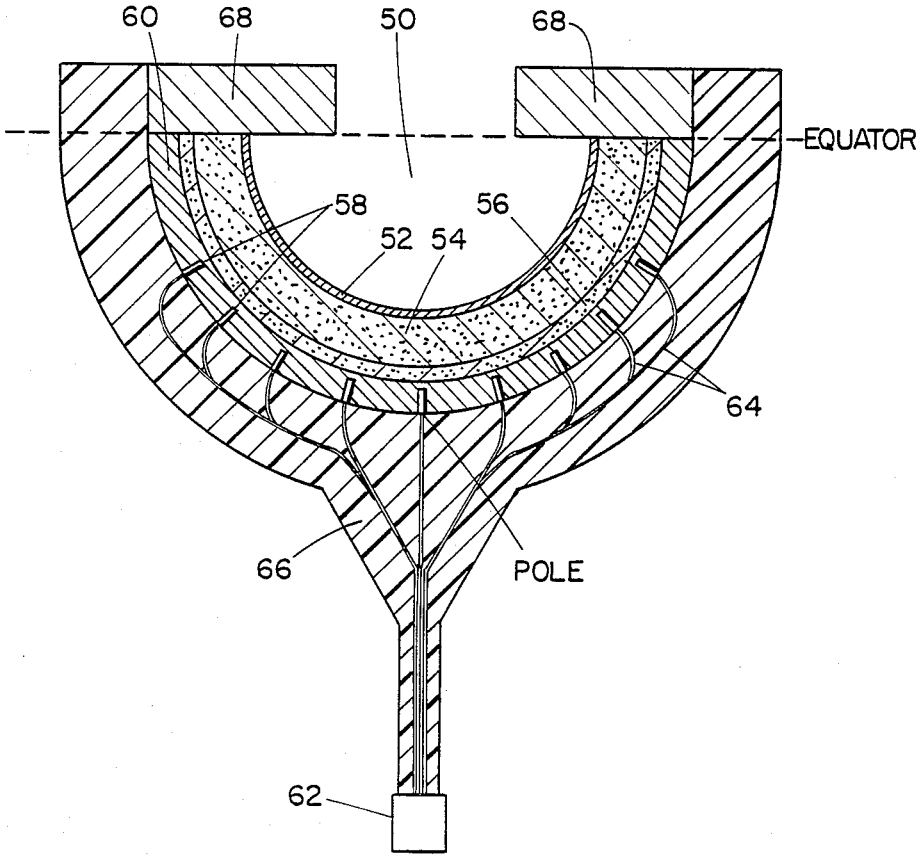
FIG. 3 is a cross-sectional view of a second embodiment of an implosion shaped charge device in accordance with the present invention.

Referring now to FIG. 3, there is illustrated a second embodiment of the implosion shaped charge device. In it overall concept, implosion shaped charge device 50 comprises liner 52, primary explosive 54 and laser initiated explosive detonator means for detonating primary explosive 54. Liner 52 is again preferably constructed in a heispherical shape of a high density liner material, such high density liner material having sufficient ductility under the explosive conditions encountered within device 50 to allow the desired jet formation. In the preferred embodiment liner 52 is comprised of approximately 26 grams of a ductile composition of depleted uranium (DU), such as DU-6Nb, hemispherically shaped, with an outer diameter of approximately 1.336 inches and a thickness of approximately 0.03 inches.

Contiguous to the outer surface of liner 52 is primary explosive 54. In the preferred embodiment primary explosive 54 is also of hemispherical shape, comprising approximately 22.5 grams of the commercially available explosive RDX.

For ease of detonation of primary explosive 54, auxiliary explosive 56 is placed contiguous to the outer surface of primary explosive 54. In the preferred embodiment, auxiliary explosive 56 is comprised of a booster material of hemispherical shape, such as approximately 10 grams of commercially available Detasheet or cyclonite.

Continguous to the outer surface of auxiliary explosive 56 is housing 60 which houses a plurality of microdetonators 58 for detonating auxiliary explosive 56. In the preferred embodiment housing 60 comprises a hemispherically shaped steel member having a plurality of recesses therein for housing microdetonators 58. As in the placement of the cavities upon throw plate 16, the recesses in housing 60 are arranged in a plurality of circles, the planes of which are parallel to the equator. The number of recesses per circle likewise follows the relationship expressed in Equation 3. Further, a single recess is placed at the pole of housing 60, and the plurality of circles is arranged so that the lines joining the recesses and the center of the hemispherical portion of primary explosive 54 divide the curved surface of primary explosive 54 into equal area segments.

As previously mentioned, the recesses in housing 60 are for housing microdetonators 58. In the preferred embodiment, microdetonators 58 are laser detonated and capable of in turn detonating auxiliary explosive 56, such as the type described in Yang, "Performance Characteristics of a Laser Initiated Microdetonator," *Propellants and Explosives,* vol. 6 (1981), pp. 151–57, such reference being incorporated herein for all purposes. It should be noted that the specific form and type of microdetonator utilized is exemplary only and not restrictive of the invention herein described.

Each of the plurality of microdetonators 58 is coupled to a laser initiation system by optical connector 62 and optical fibers 64, such being preferably of the low-loss (0.5 db) variety to lessen the system power requirements. The laser initiation system is provided to generate an intense beam of coharent light, the specific laser initiation system being dependent upon the type and form of microdetonator and the mode of operation, with such not being restrictive of the invention herein disclosed.

For housing the implosion shaped charge device as described above, strain relief 66 is provided which preferably comprises a molded plastic body contiguous to the outer surface of housing 60. Strain relief 66 further includes optical fibers 64 which are during the molding process set within strain relief 66 at preselected positions corresponding to the arrangement of microdetonators 58 within housing 60. Optical connector 62 is coupled to the end of the bundle of optical fibers 64 at the end of strain relief 66 for coupling device 50 to the laser initiation system.

For guiding the liner material toward the center of the implosion are and for delaying the arrival or relief waves, flange 68 is provided which preferably comprises a steel body having an inner diameter of approximately 0.8 inches and a thickness of approximately 0.2 inches. Flange 68 may be secured to device 50 by any number of conventional methods such as, but not limited to, welding, glueing or form fitting.

In the preferred operation of device 50, a laser in the laser initiation system is pulsed with sufficient energy to detonate the plurality of microdetonators 58. The impulse from this detonation in turn detonates auxiliary explosive 56 at multiple points along its outer surface. The resulting detonation wave spreads to primary explosive 54, with the impulse from this detonation providing the implosion impulse to liner 52. Due to the multiple point detonation of auxiliary explosive 56, however, the detonation front reaching liner 52 will be uneven and thereby preferentially accelerate those portions of liner 52 opposite the initiation sites. Such "ripple" effect is lessened by the venting of gases through the recesses which have become gas-venting holes due to the detonation of microdetonators 58. This gas venting lessens the impulse at the points of liner 52 which were preferentially accelerated, thereby providing a more uniform impulse to liner 52 with the effect of having approximately constant acceleration over the entire surface of liner 52. The constant acceleration forces liner 52 to converge radially and collapse into a small volume, from which a jet is propogated in the direction of the maximum pressure gradient, that direction being through the opening of flange 68 and into the object being perforated.

Figure 4:
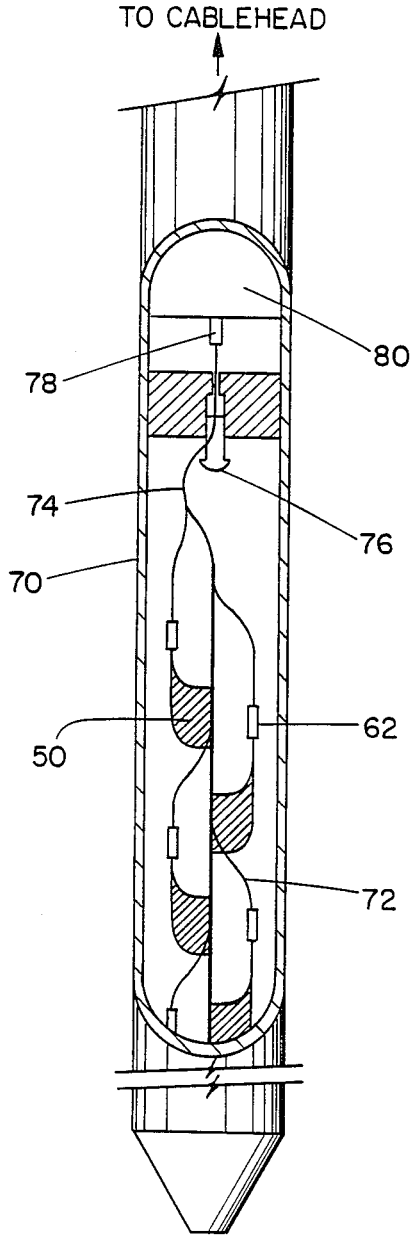
FIG. 4 is a cross-sectional view of a shaped charge perforating gun assembly utilizing the implosion shaped charged devices as illustrated in FIG. 3.

In applying device 50 for use in the oil and gas industry, a plurality of devices 50 may be loaded into a shaped charge perforating gun to perforate subsurface earth formations. Referring now to FIG. 4, there is illustrated a shaped charge perforating gun adapted to utilizing the laser initiated implosion shaped charge devices. Each device 50 is optically coupled to a branch 72 of main fiber bundle 74 by optical connector 62. Main fiber bundle 74 is connected through seal system 76 to optical connector 78 for providing the necessary optical coupling to the laser of laser and power supply 80, such being housed in a separate portion of gun 70 to isolate it from the explosive blasts of device 50. Gun 70 is further preferably adapted to be lowered in to a well bore attached to the end of a single or multi-conductor cable and cablehead assembly.

In the operation of gun 70, the laser in laser and power supply 80 is pulsed in response to electrical signals sent from the surface. The beam from the laser passes through optical connector 78 and seal system 76 to main fiber bundle 74, where such beam is disseminated to each device 50 via branch 72 and optical connector 62. The beam then initiates each device 50 approximately simultaneously in the manner herein before described.

It is therefore apparent that the present invention is one well adapted to obtain all of the advantages and featues hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention are only illustrative and explanatory thereof, and the invention admits of various changes in size, shape and material composition of its components, as well as in the details of the illustrated construction, without departing from the scope and spirit thereof.

The embodiments of the invention in which an exclusive property or privilege is claimed are defined as follows:

1. An implosion jet perforating device, comprising:

a liner of implosive geometry; primary explosive means contiguous to said liner for providing implosive impulse to said liner; and laser initiated explosive means for detonating said primary explosive means, wherein said laser initiated explosive detonator means comprises:

auxiliary explosive means for detonating said primary explosive means; and a plurality of laser initiated microdetonator means for detonating said auxiliary explosive means.

2. The device of claim 1, wherein said liner comprises a hemispherically shaped first member.

3. The device of claim 2, wherein said first member comprises a high density material of sufficient ductility to produce a jet under the implosive condition encountered during the detonation of said device.

4. The device of claim 1, wherein said primary explosive means comprises a hemispherically shaped second member.

5. The device of claim 1, wherein said explosive means comprises a vented laser initiated explosive detonator means.

6. The device of claim 1, further comprising:

means secured to said device for directing the imploded liner and for delaying the arrival of relief waves; and housing means for housing said liner, primary explosive means and explosive means.

7. The device of claim 5, further comprising means contiguous to said auxiliary explosive means for housing said plurality of laser intitated microdetnonator means.

8. The device of claim 7, further comprising means for optically coupling each of said plurality of laser initiated microdetonators to a means for generating an intense beam of coharent light.

9. The device of claim 8, wherein said means for optically coupling comprises:

a plurality of optical fibers, said optical fibers being coupled to said plurality of laser initiated microdetonators; and optical coupling means for optically coupling said plurality of optical fibers to said means for generating an intense beam of coherent light.

10. A method of producing a jet for perforating utilizing an implosion shaped charge device, comprising the steps:

actuating a laser initiated explosion detonation meas wherein said step of actuating said laser initiation explosive detonation means comprises the steps of: generating an intense beam of coherent light; detonating a plurality of microdetonators in response to said generating of said intense beam of coherent light; and detonating an auxiliary explosive means in response to said detonating of said plurality of microdetonators;

detonating a primary explosive means in response to said detonating of said explosive detonation means;

producing an implosive impulse in response to said detonating of said primary explosive means;

accelerating a liner in a radially convergent fashion in response to said implosive impulse; and producing a jet in the direction of a maximum pressure gradient from said accelerated liner.

11. An implosion jet perforating gun, comprising:

a plurality of implosion jet perforating devices;

means for generating an intense beam of coherent light;

means for optically coupling said plurality of implosion jet perforating devices and means for generating an intense beam of coherent light; and means for housing said plurality of implosion jet perforating devices, means for generating an intense beam of coherent light and means for optically coupling.

12. The implosion jet perforating gun of claim 11, wherein each of said plurality of implosion jet perforating devices comprises:

a liner of implosive geometry;

primary explosive means contiguous to said liner for providing implosive impulse to said liner; and explosive means for detonating said primary explosive means.

13. The implosion jet perforating gun of claim 12, wherein said explosive means comprises a laser initiated explosive detonator means.

14. The implosion jet perforating gun of claim 11, wherein said means for generating an intense beam of coherent light comprises a laser means.

15. The implosion jet perforating gun of claim 11, wherein said means for optically coupling comprises:

a first optically coupling means optically coupled to said means for generating an intense beam of coherent light; and a main fiber bundle optically coupled to said optically coupling means and each of said plurality of implosion jet perforating devices.

* * * * *